US008029237B2

(12) United States Patent
Chang et al.

(10) Patent No.: US 8,029,237 B2
(45) Date of Patent: Oct. 4, 2011

(54) CENTRIFUGAL FAN AND HOUSING THEREOF

(75) Inventors: Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1086 days.

(21) Appl. No.: 11/889,421

(22) Filed: Aug. 13, 2007

(65) Prior Publication Data

US 2008/0019825 A1 Jan. 24, 2008

Related U.S. Application Data

(63) Continuation-in-part of application No. 10/848,075, filed on May 19, 2004, now abandoned.

(51) Int. Cl.
*F04D 17/08* (2006.01)

(52) U.S. Cl. ..... 415/206; 416/201 A

(58) Field of Classification Search ..... 415/206, 415/203, 204
See application file for complete search history.

(56) References Cited

U.S. PATENT DOCUMENTS

| | | | | |
|---|---|---|---|---|
| 3,019,963 | A * | 2/1962 | Eck | 415/204 |
| 3,597,117 | A * | 8/1971 | Zoehfeld | 415/206 |
| 3,782,851 | A * | 1/1974 | Hackbarth et al. | 415/198.1 |
| 3,831,884 | A * | 8/1974 | Schellin | 416/185 |
| 4,128,364 | A * | 12/1978 | Papst et al. | 415/206 |
| 5,188,508 | A | 2/1993 | Scott et al. | |
| 5,489,186 | A | 2/1996 | Yapp et al. | |
| 5,988,976 | A * | 11/1999 | Mayleben | 415/204 |
| 5,997,246 | A * | 12/1999 | Humbad | 415/206 |
| 6,179,561 | B1 | 1/2001 | Horng | |
| 6,589,013 | B2 | 7/2003 | Abdallah | |
| 2002/0119038 | A1 | 8/2002 | Abdallah | |

FOREIGN PATENT DOCUMENTS

| | | | |
|---|---|---|---|
| CN | 2408284 | Y | 11/2000 |
| CN | 1403718 | A | 3/2003 |
| DE | 29 05 624 | A1 | 8/1979 |
| EP | 0 971 131 | A2 | 1/2000 |
| FR | 2 059 440 | A5 | 5/1971 |
| JP | 53-115910 | | 10/1978 |
| JP | 4-125633 | U | 11/1992 |
| JP | 5-180198 | A | 7/1993 |
| JP | 6-185494 | A | 7/1994 |

* cited by examiner

*Primary Examiner* — Richard Edgar

(74) *Attorney, Agent, or Firm* — Birch, Stewart, Kolasch & Birch, LLP

(57) ABSTRACT

A centrifugal fan. The centrifugal fan has at least one air inlet and one air outlet, and at least one set of rotor blades. A sidewall extends downward from an inner margin of the air inlet to define an air-gathering chamber in the housing of the centrifugal fan for increasing airflow pressure and heat dissipating efficiency.

16 Claims, 7 Drawing Sheets

CENTRIFUGAL FAN AND HOUSING THEREOF

CROSS REFERENCE TO RELATED APPLICATION

This application is a Continuation-In-Part of U.S. patent application Ser. No. 10/848,075, filed May, 19, 2004 now abandoned and entitled "CENTRIFUGAL FAN AND HOUSING THEREOF".

BACKGROUND OF THE INVENTION

1. Field of the Invention

The present invention relates to a heat-dissipating device, and in particular to a centrifugal fan and its housing for increasing airflow pressure.

2. Description of the Related Art

In FIG. 1, a conventional blower 1 includes a frame 10, a motor 20 and an impeller 30. The frame 10 includes an air inlet 11 and an air outlet (not shown). The motor 20 is disposed on a base 101 of the frame 10 to drive the impeller 30. The impeller 30 includes a hub 31, a base plate 32 and a plurality of blades 33 disposed on the base plate 32. The blades 33 are circumferentially disposed around the hub 31.

The blades 33, however, are located in the passage of airflow and gaps therebetween are large such that the direction of airflow cannot be properly controlled during operation. Thus, it is possible to cause the output airflow to flow back to the blower, thereby decreasing heat-dissipating efficiency thereof.

To increase heat-dissipating efficiency for a high performance electronic device, an inner airflow passage is often enlarged to increase the volume of airflow. The size of the inner passage of airflow, however, is limited by the space of the applied system, creating problems such as unbalanced airflow, noise and reduced output.

It is beneficial to increase the number and size of blades to enhance airflow volume, but limits are still imposed by the limited space of the blower, with heat-dissipating efficiency decreased accordingly.

SUMMARY OF THE INVENTION

Accordingly, an object of the invention is to provide a centrifugal fan and a housing with increased airflow pressure.

Another object of the invention is to provide increased time of airflow pressurization such that variations in air pressure are stabilized.

The invention provides a housing and at least one blade structure. The housing comprises an air inlet, a first sidewall extending from an inner margin of the air inlet to create an air-gathering chamber in the housing and an air outlet connected to the air-gathering chamber. The blade structure has at least one group of rotor blades disposed in the housing.

It is preferable that the housing comprises a first frame provided with a base to support the blade structure and a second frame provided with the air inlet.

The centrifugal fan further comprises a driving device disposed on the base of the housing to rotate the blade structure.

It is also preferable that the first sidewall of the housing comprises a flange extending outwardly to define an entrance to the air-gathering chamber. The blade structure comprises a first group of rotor blades and a second group of rotor blades. The first group of rotor blades is disposed near the air inlet of the housing, and the second group of rotor blades faces the entrance of the air-gathering chamber. The blade structure further comprises a hub provided with a protrusion extending radially to the entrance of the air-gathering chamber, and the at least one group of rotor blades of the blade structure are circumferentially disposed around the hub. The at least one group of rotor blades of the blade structure extends radially with respect to the protrusion to guide the airflow into the air-gathering chamber.

Alternatively, a second sidewall extends from a base of the housing to define an entrance of the air-gathering chamber with the first sidewall extending from the air inlet of the housing. A portion of each of the group of rotor blades extends toward the entrance of the air-gathering chamber to guide airflow into the air-gathering chamber.

The first sidewall of the housing includes two extension walls.

Additionally, the centrifugal fan further comprises at least one set of stator blades disposed on the first sidewall of the housing or near the air inlet or outlet of the housing to increase air pressure. The at least one set of stator blades and the at least one group of rotor blades are arranged alternately.

The air-gathering chamber partially or completely overlaps the passage of the blade structure and the stator blades in height along the axis of the centrifugal fan. Size of the cross section of the air-gathering chamber is substantially equal to that of the air outlet of the housing.

A side of each of the rotor blade near the air inlet of the housing comprises a slanted surface.

The blade structure comprises a first group of rotor blades and a second group of rotor blades connected to the first group of rotor blades by bolting, clamping, infusion or adhesion.

Furthermore, a centrifugal fan of the invention according to another embodiment comprises a housing and at least one blade structure. The housing comprises an air inlet, an air outlet and at least one stator blades. The blade structure has a plurality of rotor blades disposed in the housing.

A detailed description is given in the following embodiments with reference to the accompanying drawings.

BRIEF DESCRIPTION OF THE DRAWINGS

The present invention is more fully understood by reading the subsequent detailed description and examples with references made to the accompanying drawings, wherein.

DETAILED DESCRIPTION OF THE INVENTION

Figure 2:
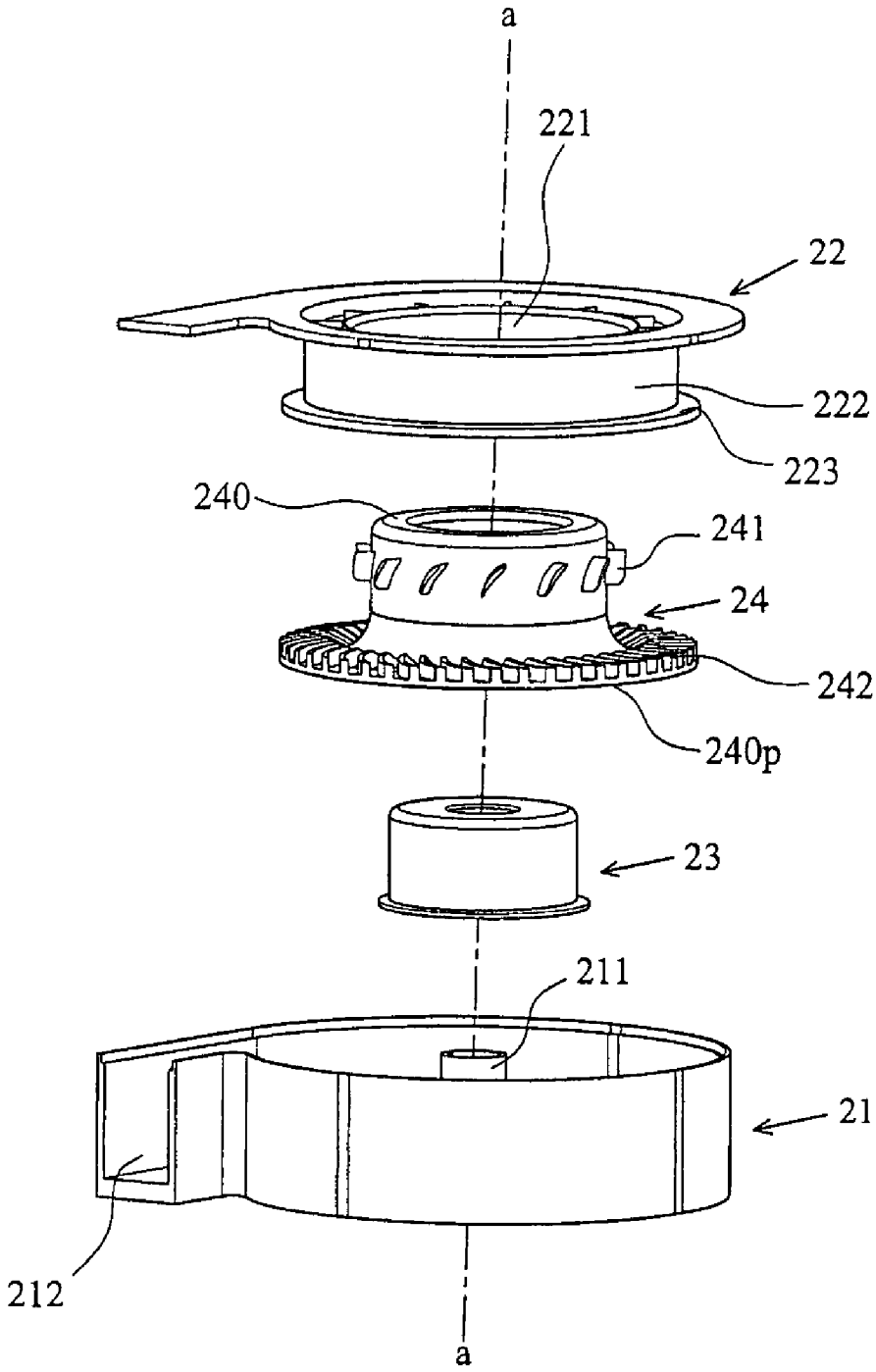
FIG. 2 is an exploded view of a centrifugal fan according to a first embodiment of the present invention.
Figure 3:
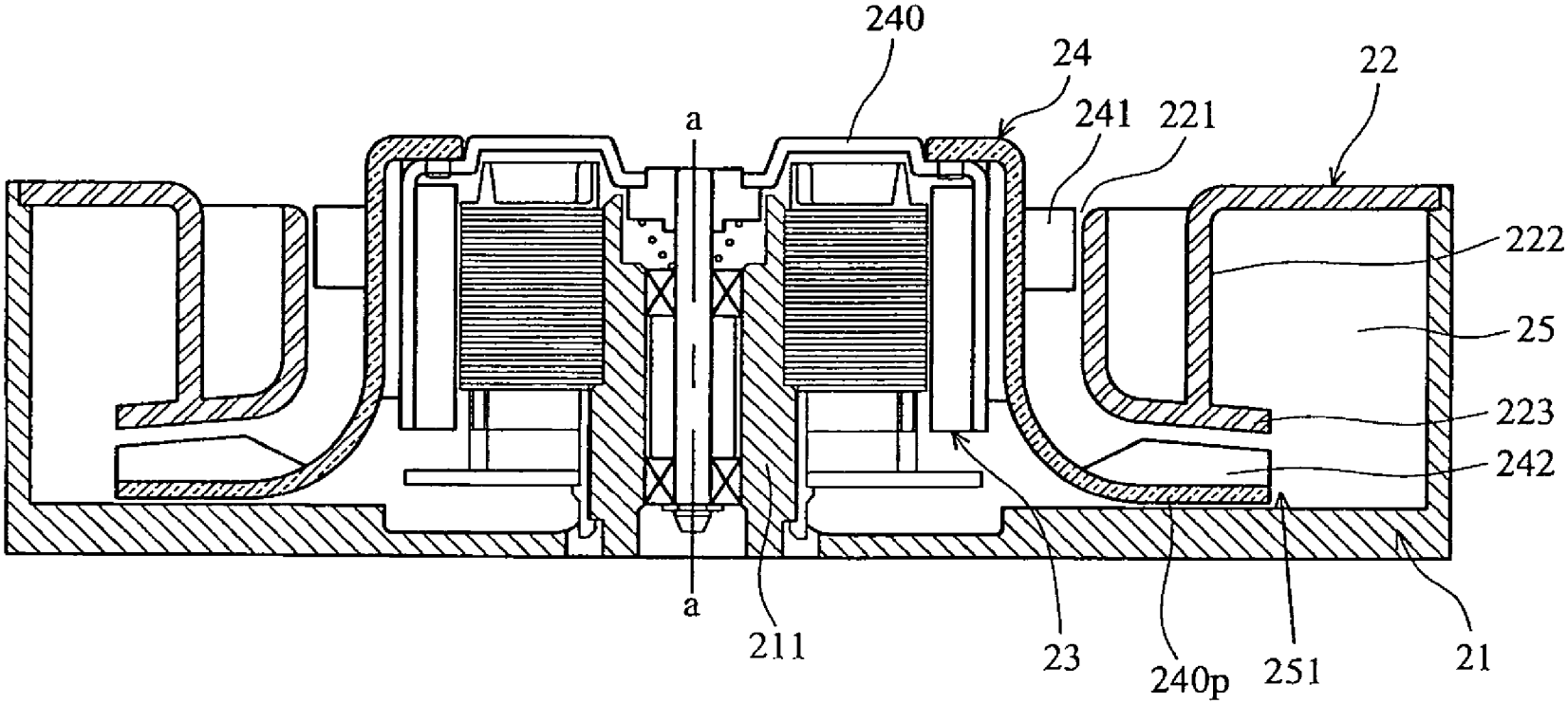
FIG. 3 is a sectional view of the inner structure of the centrifugal fan of FIG. 2.

Referring to FIGS. 2 and 3 showing a first embodiment of the invention, a centrifugal fan is a single-suction blower, including a housing disposed along an axis a-a and constituted by a first frame 21 and a second frame 22, a driving device 23 and a blade structure 24 disposed in the housing with respect to the axis a-a.

The first frame 21 includes a base with a bearing tube 211 for receiving and supporting the driving device 23. The second frame 22 includes an air inlet 221 and a first sidewall 222 extending downward from an inner margin of the air inlet 221. A flange 223, outwardly and radially extending, is disposed on the bottom of the second frame 22 to define an entrance 251 of the air-gathering chamber 25 and a space for receiving the blade structure 24 when the first and second frame 21 and 22 are combined together. The flange 223 is directly extended from the end of the first sidewall. The first sidewall 222 and the flange 223 are integrally formed as a single piece.

The blade structure 24 includes a first group of rotor blades 241 and a second group of rotor blades 242. The first group of rotor blades 241 and the second group of rotor blades 242 are respectively disposed near the air inlet 221 of the second frame 22 and near the entrance 251 of the air-gathering chamber 25.

As the driving device 23 and the blade structure 24 are disposed in the first frame 21 and the second frame 22 is connected to the first frame 21, the air-gathering chamber 25 and an air outlet 212 (see FIG. 2) are created between the first frame 21 and the second frame 22. The blade structure 24 further includes a hub 240 with a protrusion 240*p* extending radially toward the entrance 251 for allowing the second group of rotor blades 242 to be formed thereon to guide the airflow into the air-gathering chamber 25. The driving device 23, disposed in the hub 240 of the blade structure 24 but not protruding out of the hub 240, i.e., the bottom 230*b* of the driving device 23 is flush with the bottom 240*b* of the hub 240, rotates the blade structure 24 about the axis a-a of the bearing tube 211 of the first frame 21.

As the blade structure 24 rotates, the airflow passes through the air inlet 221 and the first group of rotor blades 241, and is guided into the air-gathering chamber 25 by the second group of rotor blades 242. In the air-gathering chamber 25, the airflow is gradually collected and discharged therefrom to the exterior via the air outlet 212 at high pressure. Thus, the airflow sequentially passes the air inlet 221, the first group of rotor blades 241, the second group of rotor blades 242 and the entrance 251 of the air-gathering chamber 25.

Because the first sidewall 222 extends downward from the inner margin of the air inlet 221 and separates the air-gathering chamber 25 from the blade structure 24 and the size of the air outlet 212 is reduced, time of airflow pressurization by the blade structure 24 is increased such that variations in air pressure are stabilized. Further, because the height of the air-gathering chamber 25 partially or completely overlaps that of the channel for air passing through the blade structure 24 along the axis a-a of the blade structure 24, the centrifugal fan can be minimized. The cross-sectional area of the air-gathering chamber 25 is substantially equal in size to that of the air outlet 212 such that airflow can constantly and stably move within the air-gathering chamber 25 and the air outlet 212 to prevent work loss.

On one edge of the blade structure 24 near the air inlet 221, each blade 241 of the blade structure 24 has a slanted surface such that area of the air inlet 221 for work is increased and airflow intake via the air inlet 221 is enhanced.

Figure 4:
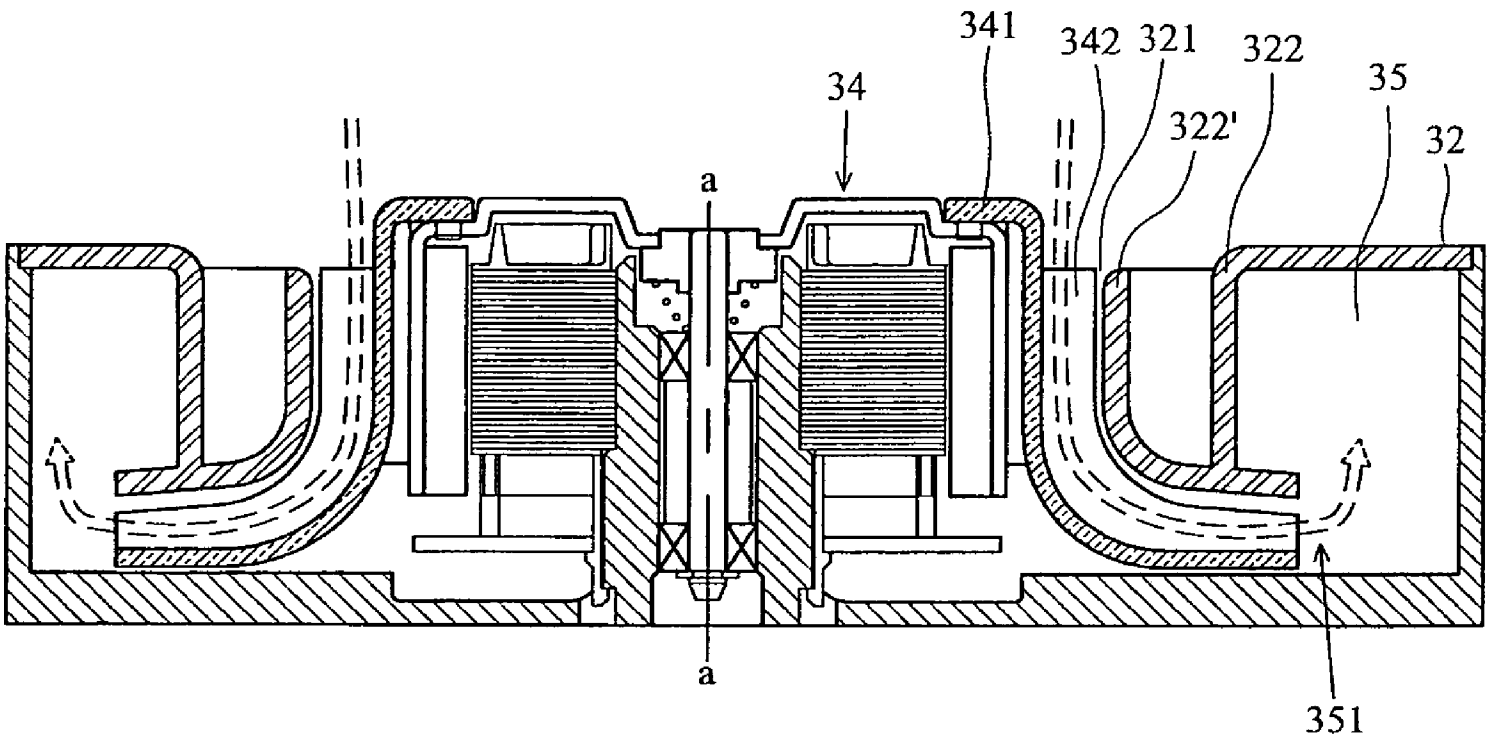
FIG. 4 is a sectional view of the inner structure of a centrifugal fan according to a second embodiment of the present invention.

Referring to FIG. 4, in a second embodiment, the structure differs from the first embodiment in that a blade structure 34 is provided with only one group of rotor blades 342 circumferentially disposed around the hub 341 of the blade structure 34, and the bottom of the hub 341 extends radially for allowing the rotor blades 342 to extend downward from the air inlet 321 of the second frame 32 to the region near the entrance 351 of the air-gathering chamber 35, and a first sidewall of the second frame 32 is formed by two-layer walls 322, 322' extending downward to separate the air-gathering chamber from the blade structure 34. Due to the increased time of airflow pressurization in the air-gathering chamber 35, variations in air pressure in the passage are stabilized.

Figure 5:
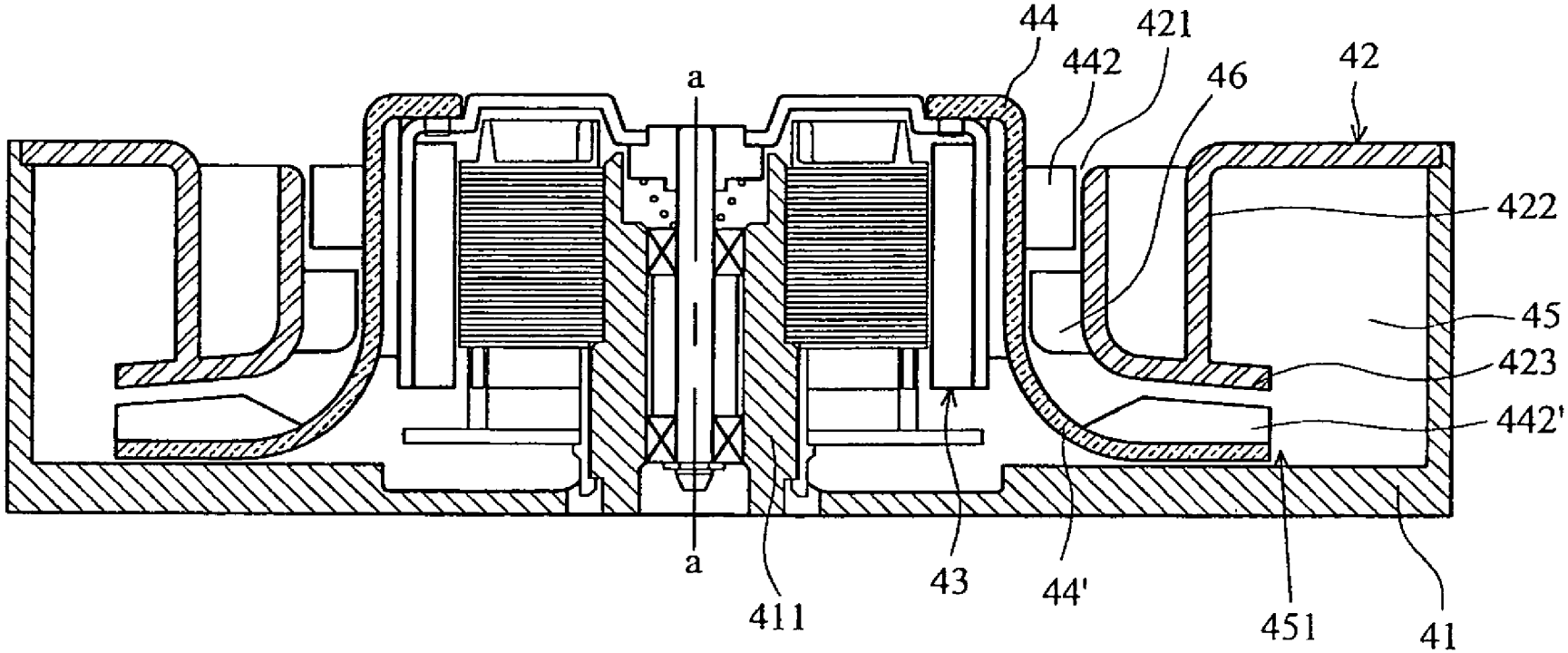
FIG. 5 is a sectional view of the inner structure of a centrifugal fan according to a third embodiment of the present invention.

Referring to FIG. 5, in a third embodiment, the centrifugal fan includes a first frame 41, a second frame 42, a driving device 43 and an impeller.

The first frame 41 includes a bearing tube 411 to receive the driving device 43. The second frame 42 includes an air inlet 421 and a first sidewall 422 extending downward from an inner margin of the air inlet 421. A flange 423, outwardly and radially extending from the first sidewall 422, is formed on the bottom of the second frame 42 to define an entrance 451 of the air-gathering chamber 45.

The structure of the centrifugal fan of the third embodiment differs from that of the first embodiment of FIG. 3 in that a group of stator blades 46 are formed on the first sidewall 422 of the second frame 42 for guiding the airflow and effectively increasing the air pressure.

The impeller includes an upper blade structure 44 having a first group of rotor blades 442, and a lower blade structure 44' having a second group of rotor blades 442'. The bottom of the lower blade structure 44' extends toward the entrance 451 of the air-gathering chamber 45 radially, and the rotor blades 442' of the lower blade structure 44' are located in the entrance 451 of the air-gathering chamber 45. The stator blades 46 of the second frame 42 are located between the rotor blades 442 and the rotor blades 442', i.e., the rotor blades 442 of the upper blade structure 44 and the rotor blades 442' of the lower blade structure 44' are respectively located above and below the stator blades 46 of the second frame 42.

The upper blade structure 44 is connected to the lower blade structure 44' preferably by bolting, clamping, infusion or adhesion.

In addition to the arrangement of the stator blades 46 and the rotor blades 442, 442' in FIG. 5, the stator blades can be formed on the first sidewall of the second frame near the air inlet of the second frame, and the rotor blades of the impeller are disposed below the stator blades, i.e., locations of the stator blades 46 and the rotor blades 442 of the upper blade structure 44 mentioned in FIG. 5 are interchangeable. Additionally, the number and arrangement of the stator blades 46 and the rotor blades 442 can be modified or selected based on applications. For example, if the centrifugal fan of the invention is an inverted-hang fan or a dual-suction blower, the stator blades can also be provided on another air inlet of the fan. Moreover, the stator blades can be disposed on the air outlet of the centrifugal fan, or respectively on the air outlet and inlet sides of the centrifugal fan.

Figure 6:
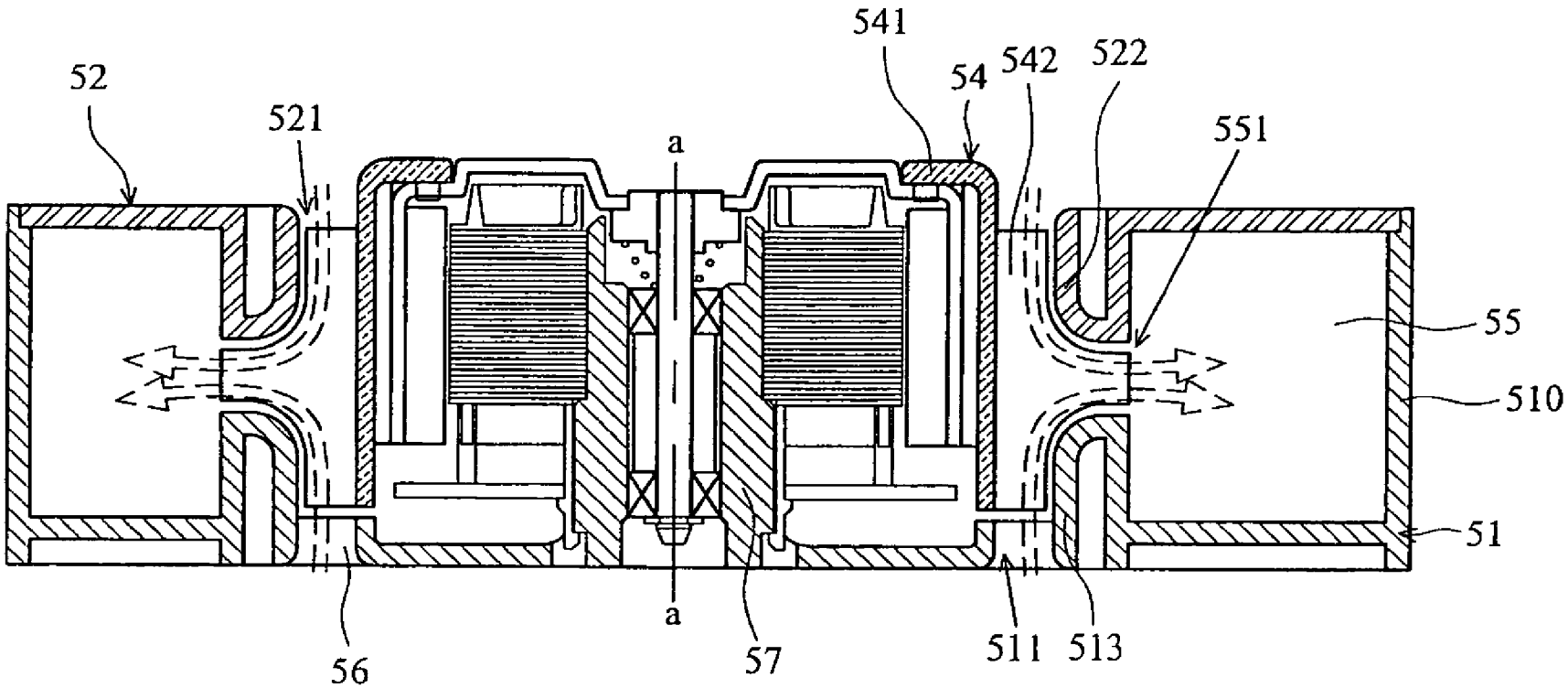
FIG. 6 is a sectional view of the inner structure of a centrifugal fan according to a fourth embodiment of the present invention.

Referring to FIG. 6, in a fourth embodiment, the centrifugal fan is a dual-suction blower, with structure differing from the second embodiment of FIG. 4 in that the entrance 551 of the air-gathering chamber 55 is defined by a first sidewall 522 extending downward from the inner margin of the air inlet 521 of the second frame 52 and a second sidewall 513 extending upward from the base 57 of the first frame 51, and the rotor blades 542 disposed on the circumference of the hub 541 of the blade structure 54 extend horizontally to the entrance 551 of the air-gathering chamber 55.

As air enters the air inlet 511 of the first frame 51 and the air inlet 521 of the second frame 52, the airflow is guided to the entrance 551 of the air-gathering chamber 55 by the rotor blades 542, indicated by the imaginary arrows in FIG. 6.

Additionally, one set of stator blades 56, substantially shaped as rotor blades 542 can be provided between the second sidewall 513 of the first frame 51 and the base of the first frame 51 for guiding airflow and increasing air pressure.

Figure 1:
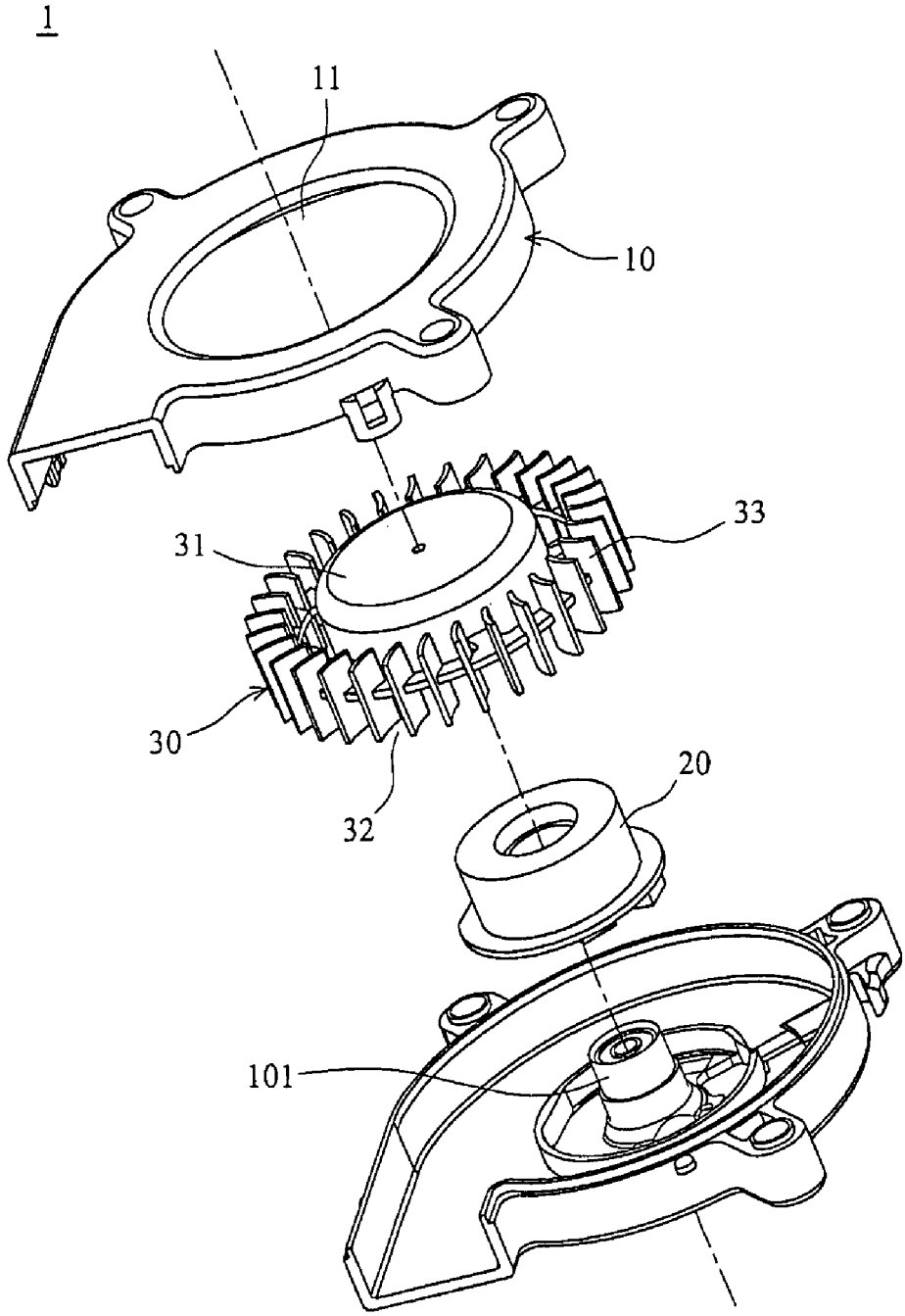
FIG. 1 (RELATED ART)
FIG. 1 is an exploded view of a conventional blower.
Figure 7:
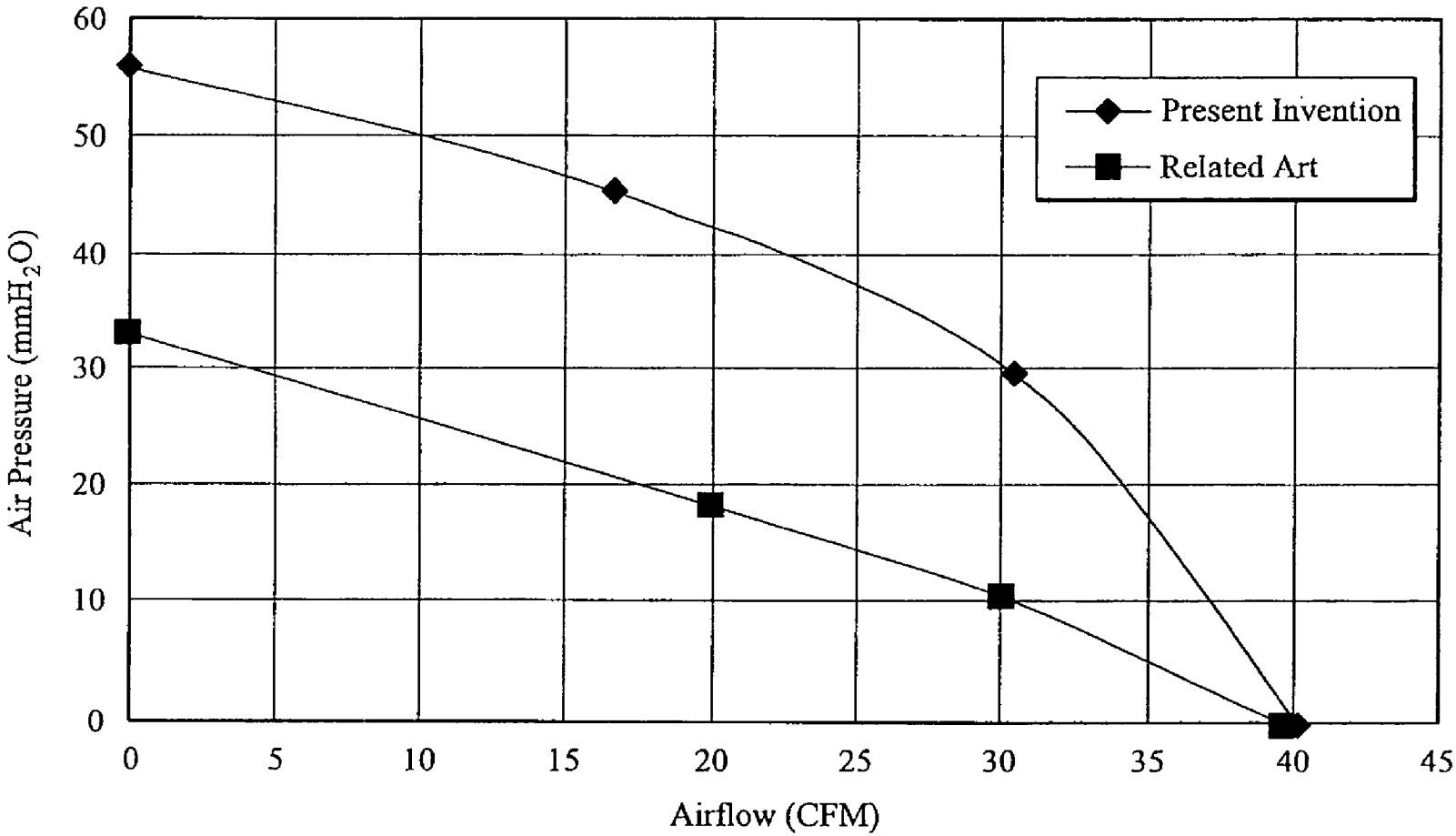
FIG. 7 shows the airflow and pressure comparison between the conventional blower of FIG. 1 and the centrifugal fan of the present invention.

FIG. 7 shows the comparison of the air pressure and airflow of the centrifugal fan of the invention between those of the conventional blower of FIG. 1. This figure can demonstrate that the air pressure and air flow of the centrifugal fan of the invention are greater that those of the prior art.

According to the embodiments mentioned above, the first sidewall extends downward from an inner margin of the air inlet to define the air-gathering chamber or air-collecting tank in the centrifugal fan so as to provide constant air pressure.

In addition, the stator blades disposed on one or more air inlet sides or outlet side of the centrifugal fan can greatly increase the air pressure of the discharged airflow for enhancing the heat-dissipating efficiency.

While the invention has been described in connection is with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. A centrifugal fan, comprising:

a housing comprising at least one air inlet, a first sidewall extending from an inner margin of the air inlet to create an air-gathering chamber in the housing and having a flange extending from the first side wall toward an inside of the air-gathering chamber directly to define an entrance to the air-gathering chamber, and an air outlet connected to the air-gathering chamber, wherein the first sidewall and the flange are integrally formed as a single piece;

at least one blade structure disposed in the housing, comprising:

a hub provided with a protrusion extending radially to the entrance of the air-gathering chamber;

a first group of rotor blades disposed near the air inlet of the housing; and a second group of rotor blades facing the entrance of the air-gathering chamber and arranged outwardly and radially, wherein the first group of rotor blades and the second group of rotor blades are circumferentially disposed around the hub and extended along a direction from the air inlet to the entrance of the air-gathering chamber; and a driving device disposed in the hub without protruding out of the hub to rotate the rotor blades.

2. The centrifugal fan as claimed in claim 1, wherein the housing further comprises a first frame provided with a base to support the blade structure, and a second frame provided with the air inlet.

3. The centrifugal fan as claimed in claim 1, wherein the second group of rotor blades extends radially with respect to the protrusion to guide the airflow to the air-gathering chamber.

4. The centrifugal fan as claimed in claim 1, wherein the first sidewall of the housing includes two extension walls.

5. The centrifugal fan as claimed in claim 1 further comprising at least one set of stator blades disposed on the first sidewall of the housing or near the air inlet or outlet of the housing to increase air pressure.

6. The centrifugal fan as claimed in claim 5, wherein the at least one set of stator blades and the first or second group of rotor blades are arranged alternately.

7. The centrifugal fan as claimed in claim 5, wherein the air-gathering chamber partially or completely overlaps the air passage of the blade structure to the stator blades in height along the axis of the centrifugal fan.

8. The centrifugal fan as claimed in claim 1, wherein a cross-sectional area of the air-gathering chamber is substantially equal to that of the air outlet of the housing.

9. The centrifugal fan as claimed in claim 1, wherein a side of each of the first group of rotor blades near the air inlet of the housing comprises a slanted surface.

10. The centrifugal fan as claimed in claim 1, wherein the first group of rotor blades and the second group of rotor blades connected to the first group of rotor blades by bolting, clamping, infusion or adhesion.

11. The centrifugal fan as claimed in claim 1, wherein the second group of rotor blades is disposed on the protrusion of the hub.

12. A centrifugal fan, comprising:

a housing comprising an air inlet, an air outlet, at least one set of stator blades, and a first sidewall extending from an inner margin of the air inlet of the housing to create an air-gathering chamber in the housing, wherein the stator blades extend from the first sidewall toward an axis of the fan and the first sidewall of the housing comprises a flange extending from the first side wall toward an inside of the air-gathering chamber directly to define an entrance to the air-gathering chamber, wherein the first sidewall and the flange are integrally formed as a single piece;

at least one set of blade structure disposed in the housing, comprising:

a hub provided with a protrusion extending radially to the entrance of the air-gathering chamber;

a first group of rotor blades disposed near the air inlet of the housing; and a second group of rotor blades facing the entrance of the air-gathering chamber and arranged outwardly and radially, wherein the first group of rotor blades and the second group of rotor blades are circumferentially disposed around the hub and extended along a direction from the air inlet to the entrance of the air-gathering chamber; and a driving device disposed in the hub without protruding out of the hub to rotate the rotor blades.

13. The centrifugal fan as claimed in claim 12, wherein the first sidewall of the housing includes two extension walls.

14. The centrifugal fan as claimed in claim 12, wherein the air-gathering chamber partially or completely overlaps the air passage of the blade structure to the stator blades in height along the axis of the centrifugal fan.

15. The centrifugal fan as claimed in claim 12, wherein the second group of rotor blades extends radially toward the entrance of the air-gathering chamber for guiding the airflow to the air-gathering chamber.

16. The centrifugal fan as claimed in claim 12, wherein the second group of rotor blades is disposed on the protrusion of the hub.

* * * * *